United States Patent [19]

Lynch et al.

[11] 4,182,661

[45] Jan. 8, 1980

[54] ELECTROCHEMICAL PRODUCTION OF AVAILABLE CHLORINE CONTAINING ORGANIC COMPOUNDS IN A DIVIDED CELL

[75] Inventors: Richard W. Lynch, Chattanooga; Ronald L. Dotson, Cleveland, both of Tenn.

[73] Assignee: Olin Corporation, New Haven, Conn.

[21] Appl. No.: 929,092

[22] Filed: Jul. 31, 1978

[51] Int. Cl.[2] ..... C25B 3/02

[52] U.S. Cl. ..... 204/78; 204/79

[58] Field of Search ..... 204/72, 78–81

[56] References Cited

U.S. PATENT DOCUMENTS

| | | | |
|---|---|---|---|
| 3,288,692 | 11/1966 | Leduc | 204/80 |
| 3,449,225 | 6/1969 | Matzner et al. | 204/81 |
| 3,451,905 | 6/1969 | Kronig et al. | 204/80 |
| 4,008,133 | 2/1977 | Gelbein et al. | 204/80 |

*Primary Examiner*—F. C. Edmundson

*Attorney, Agent, or Firm*—Gordon F. Sieckmann; Donald F. Clements

[57] ABSTRACT

An electrolytic process for preparing organic hypohalite compounds from an aqueous brine and organic alcohol solution in a multi-chamber membrane type cell. For example, tertiary butyl hypochlorite is prepared in a membrane cell from tertiary butyl alcohol and a sodium chloride brine. An organic solvent such as carbon tetrachloride can be used to extract the organic hypohalite formed in the aqueous brine phase either during or after electrolysis.

39 Claims, No Drawings

ELECTROCHEMICAL PRODUCTION OF AVAILABLE CHLORINE CONTAINING ORGANIC COMPOUNDS IN A DIVIDED CELL

The present invention relates to a novel electrolytic process for preparing organic hypohalites from a solution of an aqueous brine and an organic alcohol in a divided membrane cell.

The prior art teaches the use of organic hypohalites as halofunctionalization agents, e.g., an agent which gives a halogen in a +1 valence state, in the manufacture of propylene oxide, calcium hypochlorite and other industrial chemicals. Although organic hypohalites may be produced by prior art chemical and electrolytic processes, certain problems with respect to safety, economics, pollution, and purity in these processes demonstrate the need for an improved process.

For example, U.S. Pat. No. 2,694,722, issued Nov. 16, 1954 to Irving Katz, discloses a process for preparing alkyl hypochlorites which consists of dissolving an inorganic hypochlorite salt such as sodium hypochlorite and an organic alcohol such as tertiary butyl alcohol in water and then adding carbon dioxide. Alkyl hypochlorite is produced according to this patent in accordance with the chemical equation, $$NaOCl + CO_2 + (CH_3)_3COH \rightarrow (CH_3)_3COCl + NaHCO_3.$$

Another example, U.S. Pat. No. 1,938,175, issued Dec. 5, 1933 to Richard M. Deanesly, discloses a process for preparing alkyl hypochlorites according to the following:

$$NaOH + C_4H_9OH + Cl_2 \rightarrow C_4H_9OCl + NaCl + H_2O$$

$$KOH + ROH + Cl_2 \rightarrow ROCl + KCl + H_2O$$

where ROH is any aliphatic alcohol of primary, secondary, or tertiary character.

The above described processes for chlorinating organic compounds have certain disadvantages in that by-products such as sodium bicarbonate, potassium chloride, or sodium chloride are formed along with the chlorinated organic compounds.

In another example, U.S. Pat. No. 3,449,225, issued to Edwin A. Matzner on June 10, 1969, discloses an electrolytic process for preparing organic hypohalites from inorganic halides and organic compounds in an undivided cell. The patent discloses that a mixture of a brine solution and an organic alcohol, such as tertiary butyl alcohol, is charged to an undivided cell containing five pairs of equally spaced circular electrodes. However, in the disclosed example, extremely low temperatures were used as the cell temperature was maintained at 1°±1° C. Hydrochloric acid was added to the cell during electrolysis to consume excess NaOH and to maintain the pH of the solution of about 8 to about 9. After electrolysis, the pH of the solution was adjusted to about 7. Current density was about 0.1 ampere per square centimeter at a voltage of about 5.4 volts.

OBJECTS

It is a primary object of this invention to provide an improved electrolytic process for preparing organic hypohalites.

A further object is to provide an improved electrolytic process for preparing organic hypohalites in which safety, economics, pollution, and product purity problems are greatly reduced.

Still another object of this invention is to provide an improved electrolytic process for preparing tertiary butyl hypochlorite in which safety, economics, pollution, and product purity problems are greatly reduced.

A further object of this invention is to provide an improved electrolytic process for preparing tertiary butyl hypochlorite in which excess caustic soda produced by separating the anolyte and the catholyte chambers is collected and recovered for use.

A further object of this invention is to provide an improved electrolytic process for preparing high purity tertiary butyl hypochlorite with minimum solvent usage.

These and other objects of the invention will become apparent from the following description and the appended claims.

BRIEF DESCRIPTION OF THE INVENTION

The foregoing objects of the invention are accomplished in the process of this invention, utilizing an electrolytic cell having an anolyte chamber and a catholyte chamber, each containing electrodes separated by a separator, which comprises charging a mixture of brine and an organic alcohol into the anolyte chamber, charging a dilute aqueous caustic solution to the catholyte chamber, passing a current between the anode and the cathode whereby the organic hypohalite is formed in the anolyte chamber, and recovering organic hypohalite from the anolyte chamber.

Employing this process, it is possible to obtain product yields as high as 100% of that theoretically possible based on the organic compound employed. The organic hypohalites of this invention are useful in the preparation of propylene oxide and calcium hypochlorite, or any process wherein a +1 valence state of a halogen is desired.

DETAILED DESCRIPTION OF THE INVENTION

The electrolytic cell employed in this invention may be a commercially available or a custom built electrolytic cell of a size and electrical capacity capable of economically producing the desired organic hypochlorite product.

A particularly advantageous electrolytic cell which may be employed in the practice of this process has separate anolyte and catholyte chambers, using as a separator a permselective cation exchange membrane. Located on one side of the membrane partition, the anode chamber has an outlet for any oxygen or excess chlorine gas generated, and an inlet and an outlet for charging, removing, or circulating anolyte solution. On the opposite side of the membrane partition, the catholyte chamber has inlets and outlets for the caustic soda solution and an outlet for hydrogen liberated at the cathode by the electrolysis of water.

The membrane cell can be operated on a batch or flow-through system. In the latter system, anolyte and catholyte are continuously circulated to and from external solution storage vessels.

Hydrogen gas is removed from the catholyte chamber and collected for use as a fuel or otherwise disposed of. Any excess chlorine gas is likewise removed from the anode chamber and collected.

Materials suitable for use as membranes in the process of this invention include the sulfonic acid substituted perfluorocarbon polymers of the type described in U.S. Pat. No. 4,036,714, which issued on July 19, 1977 to Robert Spitzer; the primary amine substituted polymers described in U.S. Pat. No. 4,085,071, which issued on Apr. 18, 1978 to Paul Raphael Resnick et al; the polyamine substituted polymers of the type described in U.S. Pat. No. 4,030,988, which issued on June 21, 1977 to Walther Gustav Grot; and the carboxylic acid substituted polymers described in U.S. Pat. No. 4,065,366, which issued on Dec. 27, 1977 to Yoshio Oda et al. All of the teachings of these patents are incorporated herein in their entirety by reference.

With respect to the sulfonic acid substituted polymers of U.S. Pat. No. 4,036,714, these membranes are preferably prepared by copolymerizing a vinyl ether having the formula $FSO_2CF_2CF_2OCF(CF_3)CF_2OCF{=}CF_2$ and tetrafluoroethylene followed by converting the $-SO_2F$ group to a moiety selected from the group consisting of $-SO_3H$, alkali metal sulfonate, and mixtures thereof. The equivalent weight of the preferred copolymers range from 950 to 1350 where equivalent weight is defined as the average molecular weight per sulfonyl group.

With reference to the primary amine substituted polymers of U.S. Pat. No. 4,085,071, the basic sulfonyl fluoride polymer of the U.S. Pat. No. 4,036,714 above is first prepared and then reacted with a suitable primary amine wherein the pendant sulfonyl fluoride groups react to form N-monosubstituted sulfonamido groups or salts thereof. In preparing the polymer precursor, the preferred copolymers utilized in the film are fluoropolymers or polyfluorocarbons although others can be utilized as long as there is a fluorine atom attached to the carbon atom which is attached to the sulfonyl group of the polymer. The most preferred copolymer is a copolymer of tetrafluoroethylene and perfluoro(3,6-dioxa-4-methyl-7-octenesulfonyl fluoride) which comprises 10 to 60 percent, perferably 25 to 50 percent by weight of the latter. The sulfonyl groups are then converted to N-monosubstituted sulfonamido groups or salt thereof through the reaction of a primary amine.

Polymers similar to the above U.S. Pat. No. 4,085,071 are prepared as described in U.S. Pat. No. 4,030,988 wherein the backbone sulfonated fluoride polymers are reacted with a di- or polyamine, with heat treatment of the converted polymer to form diamino and polyamino substituents on the sulfonyl fluoride sites of the copolymer.

The carboxylic acid substituted polymers of U.S. Pat. No. 4,065,366 are prepared by reacting a fluorinated olefin with a comonomer having a carboxylic acid group or a functional group which can be converted to a carboxylic acid group. It is preferred to use a fluorinated copolymer having a molecular weight to give the volumetric melt flow rate of 100 millimeters per second at a temperature of 250° C. to 300° C. Preferably, the membrane is compared by copolymerizing tetrafluoroethylene with $CF_2{=}CFO(CF_2)_3COOCH_3$.

The thickness of the membrane may be in the range from about 3 to about 20 mils, and preferably from about 5 to about 10 mils. For selected membranes, a laminated inert cloth supporting material for the membrane of polytetrafluoroethylene may be used.

Although the aforesaid membranes appear to provide the highest overall efficiency of the operation of the process of this invention, one skilled in the art will recognize that any inert hydrophilic membrane material that is capable of effecting the electrolytic production of organic hypohalite from a brine containing an organic alcohol may be used in the process of this invention.

At least one electrode is positioned within the anolyte chamber and one electrode within the catholyte chamber. For maximum exposure of the electrolytic surface, the face of the electrode should be parallel to the plane of the membrane.

Examples of materials which may be employed as an anode include commercially available platinized titanium, platinized tantalum, or platinized platinum electrodes which contain, at least on the surface of the electrodes, a deposit of platinum on titanium, plantinum on tantalum or platinum on platinum. Also effective are anodes composed of graphite, or anodes comprised of a metal oxide coated substrate such as described in U.S. Pat. No. 3,632,498, issued to H. B. Beer on Jan. 4, 1972. When such electrodes are employed as anodes, anodic chlorine overvoltage is minimized. One skilled in the art will recognize, however, that any electrode construction capable of effecting electrolytic production of organic hypohalite from a brine containing an organic alcohol may be used in the process of this invention.

Examples of materials which may be employed as the cathode are carbon steel, stainless steel, nickel, nickel molybdenum alloys, nickel vanadium alloys and others. Those skilled in the art will also recognize that any cathode material that is capable of effecting the electrolytic reduction of water with either high or low hydrogen overvoltage may be used as cathode construction material in the process of this invention.

The cathode and anode may each be of either solid, felt, mesh, foraminous, packed bed, expanded metal, or other design. Those skilled in the art will recognize that any electrode configuration capable of effecting anodic eletrolytic production of organic hypohalite from a brine containing an alcohol or cathodic production of alkali metal hydroxide may be used as anodes or cathodes respectively in the process of this invention.

The distance between the electrode, such as the anode or the cathode, to the membrane is known as the gap distance for that electrode. The gap distance of the anode to membrane and the cathode to membrane are independently variable. Changing these respective distances concurrently or individually may effect the operational characteristics of the electrolytic cell and is reflected in the calculated current efficiency. For the process of this invention for each electrode, the electrode current efficiency is defined as the ratio of the number of chemical equivalents of product formed divided by the electrical equivalents consumed in forming that product × 100. This may be expressed mathematically by the following equation:

$$\%\ \text{Current Efficiency} = \frac{A/B}{C/D} \times 100$$

where

A = Mass of product produced in grams.

B = Equivalent weight of product produced in grams per equivalent.

C = Qauntity of electricity consumed in making desired product in ampere hours.

D = Faraday's Constant of 26.81 ampere hours per equivalent.

In general, preferable anode to membrane and preferable cathode to membrane gap distances can be defined for any organic alcohol and brine composition used as the anolyte in the membrane electrolytic cell. When using tertiary butyl alcohol and sodium chloride brine solution as the anolyte, the preferable anode to membrane gap distance is in the range from about 1/32 to about 1 inch, and the preferable cathode to membrane gap distance is in the range from about 1/16 to about ½ inch.

Essentially, the same distances are also useful for other alcohols and other alkali metal halide brines.

The anolyte is composed of an aqueous mixture of brine and an organic alcohol. The brine employed may be a water soluble alkali metal halide solution. Preferably, the brine is an aqueous solution of sodium chloride, sodium bromide, potassium chloride, potassium bromide, or mixtures thereof. For example, when employing sodium chloride, the brine concentration ranges from about 175 grams per liter to about 327 grams per liter and preferably, from about 250 to about 320 grams per liter of sodium chloride.

Halogenated organic compounds containing halogen atoms such as chlorine and bromine in a +1 oxidation state, bonded to oxygen atoms, may be prepared in accordance with the process of this invention. The analagous organic hypohalite compounds containing iodine and fluorine tend to be more unstable than corresponding compounds containing chlorine or bromine and it has been found generally advantageous to prepare organic compounds containing chlorine, bromine and mixtures thereof.

Any organic alcohol capable of being electrolytically transformed into the corresponding organic hypohalite in a membrane cell may be utilized in the process of this invention.

When such organic alcohols are halogenated in accordance with the process of the present invention, the hydrogen atom of the carbinol group on the alcohol molecule is replaced with an electropositive halogen atom. Useful organic alcohols are selected from the group consisting of secondary alcohols, tertiary alcohols, and cyclic alcohols.

Examples of alcohols which may be employed as hypohalite carriers in this process are secondary alcohols of the form,

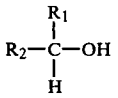

where $R_1$ and $R_2$ are each alkyl or aryl groups having 1 to about 20 carbon atoms each. Examples are isopropyl alcohol and isobutyl alcohol.

Other alcohols employed may be a tertiary diol of the form

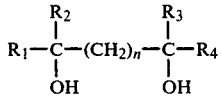

where n is an integer from 1 to about 20 and $R_1$, $R_2$, $R_3$, and $R_4$ are each alkyl or aryl groups having 1 to about 20 carbon atoms each. Preferable family members are 2,5-dimethyl-2,5-hexanediol and 2,4-dimethyl-2,4-pentanediol.

Other examples of alcohols which may be used in this process are tertiary alcohols of the form

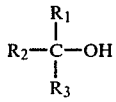

where $R_1$, $R_2$, and $R_3$ are each alkyl or aryl groups having 1 to about 10 carbon atoms each. Preferred alcohols of this type are tertiary butyl alcohol, tertiary amyl alcohol, and 3-methyl-3-pentanol.

As used throughout the description and claims, the term "alkyl" is intended to include straight chain, cyclic, substituted and substituted cyclic alkyl groups. As used throughout the description and claims, the term "aryl" is intended to include normal and substituted aromatic groups.

Other alcohols which may be used in the process of this invention are cyclohexanol and related cyclic alcohols.

It has also been found that generally the cell current efficiency increases with increasing molecular weight of the alcohol employed.

The particular water soluble alkali metal halide employed and the particular organic alcohol employed will depend upon the organic hypohalite which it is desired to be prepared. Thus, for example, when it is desired to prepare tertiary butyl hypochlorite, then sodium chloride brine and tertiary butyl alcohol can be employed.

The molar ratio of brine to organic alcohol in the anolyte employed in operation of the membrane cell ranges from about 2:1 to about 20:1 and preferably from about 3:1 to about 10:1.

The anolyte pH is maintained during all operation in the range from about 5 to about 9, and preferably in the range from about 6.5 to about 8.5 because the stability of the organic hypohalite products in the anolyte is extremely sensitive to the pH of the anolyte. Under strongly acidic conditions, chlorine gas is liberated. Under strongly alkaline conditions, the organic hypohalite hydrolyzes to organic alcohol and inorganic hypohalite. It has been found that at an anolyte pH in the range from about 6.5 to about 8.5, that the anode current efficiency, as previously defined, may be optimized. The pH can be adjusted by periodic addition of base, for example by adding appropriate amounts of caustic soda to the anolyte solution during electrolysis.

In operation of the process of this invention, direct current is supplied to the cell and a voltage is impressed across the cell terminals. Without being bound by theory, it is believed that during the operation of the process of this invention, a direct current flows to activate electrochemical charge transfer directly to the alcohol from the electrodes and mass transport phenomena therein between these electrodes. The operating temperature of the membrane cell is in the range of about −10° C. to about 80° C., preferably in the range of about −5° C. to about 40° C. The temperature may vary in the range noted above, from just above the freezing point of the anolyte to about 80° C., depending in part on factors such as the organic alcohol employed, the solubility and concentration of the brine in the aqueous anolyte, ionic strength, and the electrical conductivity of the anolyte. When the temperature of the aqueous anolyte falls or is permitted to fall near the freezing temperature, little, if any, halogenated organic compound will be formed because of substantial resistance to the passage of electric current due to freezing of the anolyte solution or crystallization of alkali metal halide from the brine. On the other hand, if the temperature of the anolyte rises or is permitted to rise above about 80° C., substantial undesirable side reactions, including product decomposition often occur resulting in lower product yield.

The operating pressure of the cell is essentially atmospheric. However, sub- or superatmospheric pressures may be used, if desired.

In a first embodiment of the process of this invention, the organic hypohalite product of the membrane cell is recovered directly from the anolyte solution. However, in a second embodiment of the process of this invention, the organic hypohalite product is recovered by admixing a suitable solvent with the anolyte solution containing the organic hypohalite after electrolysis.

In a third embodiment of the invention, the organic solvent is admixed with the anolyte before electrolysis so that during electrolysis, the organic solvent is circulated as a part of the anolyte through the cell anolyte chamber and the anolyte storage vessel.

In the first embodiment, the anolyte solution produced during electrolysis physically separates into two phases, an organic phase containing the organic hypohalite and the unreacted alcohol, and an aqueous phase which contains unreacted organic alcohol, aqueous brine, and a minor amount of organic hypohalite. The organic phase is separated from the aqueous phase by conventional means. The resulting organic phase containing organic hypohalite and alcohol may be used as a reactant in processes such as for the preparation of propylene oxide, calcium hypohalite and the like, with or without further purification. The aqueous phase is reconstituted and recycled to the anolyte chamber as needed.

In the second embodiment, in which the solvent is mixed with the anolyte solution after removal from the membrane cell, the anolyte solution comprised of an organic phase containing organic hypohalite and organic alcohol and an aqueous phase containing brine and organic alcohol is conveyed to a suitable mixing vessel which is provided with agitation means. A suitable solvent described below is added to the mixing vessel in a sufficient proportion to extract substantially all of the organic hypohalite from the anolyte solution. In addition, the solvent contains sufficient organic alcohol to maintain a desired concentration of organic alcohol in the aqueous phase through normal phase distribution.

The mixture of solvent, aqueous phase, organic phase and alcohol is conveyed from the mixing vessel to a suitable phase separator where the organic phase is separated from the aqueous phase. The organic phase which contains the solvent, organic hypohalite and a large portion of the alcohol is collected and stored for use as a reactant in chemical processes such as the preparation of propylene oxide, calcium hypochlorite and the like.

The aqueous phase, which contains the depleted brine, some of the alcohol, and a minor portion of the organic hypohalite, is removed from the phase separator and conveyed to a second mixing vessel where it is mixed with depleted or reacted organic phase, which contains the solvent, a residual amount of organic hypohalite, and organic alcohol. During mixing, organic alcohol formed from the reacted organic hypohalite is transferred from organic phase back to the aqueous phase through normal phase distribution, such that the alcohol content of the aqueous phase is enriched back to the pre-electrolysis level. The resulting mixture from the second mixing vessel is conveyed to a second phase separator where the mixture is separated into aqueous and organic layers. The organic layer is conveyed to the first mixing vessel and is used as previously described, while the aqueous layer is reconstituted in water and alkali metal halide to replenish that used in electrolysis and is recycled to the anolyte chamber of the membrane cell.

In a third embodiment of the invention, the solvent which contains organic alcohol, is fed to the anolyte chamber, either separately or mixed with the aqueous phase which contains mainly alkali metal halide brine and organic alcohol. In this embodiment, the electrolyzed aqueous/organic mixture is conveyed to a phase separator, where the mixture is separated into an organic layer which contains the solvent, organic hypohalite and organic alcohol and an aqueous layer which contains mainly depleted brine and organic alcohol. The organic hypohalite containing organic phase is collected and stored for use as previously described. The aqueous phase is reconstituted in water and alkali metal halide to replenish that used in electrolysis and is recycled to the anolyte chamber of the membrane cell, either separately or mixed with depleted organic layer which contains the solvent and organic alcohol.

The organic solvent used in the second and third embodiments may be an essentially inert liquid also essentially immiscible with the aqueous phase of the anolyte. The organic solvent extracts from the anolyte the organic hypohalite product and significant quantities of any unreacted organic alcohol, while the remainder of the unreacted alcohol and a minor amount of the organic hypohalite product will be contained in the aqueous phase.

The difference between the density of the organic phase containing organic solvent, unreacted organic alcohol and the organic hypohalite product, and the density of the aqueous phase containing the unreacted alcohol and brine is preferably of at least sufficient magnitude so that physical separation can be practiced by methods recognized by those skilled in the art. Large density differences facilitate easy separation of the organic phase from the aqueous phase.

The proportion of solvent will vary with the nature of the solvent and the organic hypohalite, but sufficient solvent is added to extract the maximum proportion of organic hypohalite from the aqueous phase.

Suitable solvents include a wide variety of halogenated hydrocarbons and organic phosphate compounds. A typical family of halogenated hydrocarbon solvents are those represented by the formula $$CH_xCl_y$$

where y is an integer from 2 to 4 and $x+y=4$.

Examples of suitable members of this family of solvents include $CCl_4$, $CHCl_3$, and $CH_2Cl_2$.

Another example of an organic solvent is an organic phosphate of the form

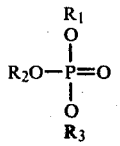

where $R_1$, $R_2$, and $R_3$ are each an alkyl or aryl group, for example, methyl, ethyl, n-butyl, isopropyl, n-pentyl, isobutyl, n-propyl, phenyl, 2-tolyl, 3-tolyl, or 4-tolyl. In general each alkyl or aryl group will have 1 to about 10 carbon atoms. Preferable family members are tri-n-butyl phosphate and tri-n-propyl phosphate.

Another example of a suitable organic solvent family is not of the general form $C_2F_xCl_y$ where y is an integer from 2 to 6 and $x+y=6$.

Examples of this family include 1,1,1-trichloro-2,2,2-trifluoroethane, 1,1,2-trichloro-1,2,2-trifluoroethane, 1,1-dichloro-1,2,2,2-tetrafluoroethane, hexachloroethane, and fluoropentachloroethane.

Another example of a suitable family of organic solvents is of the form $C_2H_xCl_y$ where y is an integer from 1 to 6 and $x+y=6$.

Examples of this family include 1,2-dichloroethane, 1,1,1-trichloroethane, 1,1,2-trichloroethane, 1,1,1,2-tetrachloroethane, 1,1,2,2-tetrachloroethane, and pentachloroethane.

Another example of a suitable family of organic solvents is of the form $C_2H_xF_y$ where y is an integer from 1 to 2 and $x+y=6$. A specific example is 1,2-difluoroethane.

Another example of a suitable organic family of solvents is of the form $C_3H_xCl_y$ where y is an integer from 1 to about 4 and $x+y=8$.

Examples of this family include isopropyl chloride, 1,2-dichloropropane, 1,1,1,2-tetrachloropropane, and 1,1,2,2-tetrachloropropane.

Another example of a suitable organic family of solvents is a tertiary halide of the form

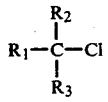

where $R_1$, $R_2$, and $R_3$ are each separate alkyl or aryl groups having from 1 to about 20 carbon atoms each. Preferable solvents include 2-chloro-2-methylpropane, 2-chloro-2-methylbutane, 2-chloro-2-methylpentane, and 3-chloro-3-ethylpentane.

Other examples of suitable organic solvents include 2-chlorotoluene, 3-chlorotoluene, 4-chlorotoluene, and alpha-chlorotoluene.

Yet other solvents which may be used include chlorobenzene, 1,2-dichlorobenzene, 1,3-dichlorobenzene, 1,2,4-trichlorobenzene, and fluorobenzene.

An advantage of the present invention is that the hydrogen gas discharged from the catholyte chamber is isolated from any chlorine gas produced in the anolyte chamber. Because of this separation of chambers, the danger of forming explosive mixtures of hydrogen and residual chlorine gas (from excess chlorine or decomposed chlorine species) is thereby minimized. This invention eliminates the need for an inert gas purge as is required in an undivided cell.

The halogenated organic product of the process of the present invention contains minimal by-products of the reaction process such as NaCl, KCl or mixtures thereof.

When employing a cell with a permselective membrane as in the present invention, sodium ions are transported across the membrane into the catholyte compartment. The concentration of the caustic soda produced in the catholyte chamber is essentially determined by the amount of any water added to this chamber from a source exterior to the cell and from any water transferred through the membrane. The concentration of sodium chloride and organic alcohol in the caustic soda product of the catholyte chamber is minimal. As a result, the process of the present invention produces a high purity caustic soda directly from the cell catholyte.

Although the invention has been described in terms of a membrane cell, those skilled in the art will recognize that the process of this invention can also be carried out in cells using other separators, for example, asbestos diaphragm cells, synthetic diaphragm cells, sintered metal diaphragm cells, and the like.

The following examples are presented to define the invention more fully without any intention of being limited thereby. All parts and percentages are by weight unless indicated otherwise.

EXAMPLE 1

Tertiary butyl hypochlorite was prepared batchwise in a divided flow-through cell having exterior dimensions which were 8 inches in height, 4 inches in width, and 5 inches in depth. An homogeneous film of cation exchange membrane (7 mils thick), 1220 equivalent weight perfluorosulfonic acid resin $CF_2{=}CFOCF_2CF(CF_3)OCF_2CF_2SO_2F$ laminated with a fabric backing of polytetrafluoroethylene resin, was positioned vertically in the center of the cell. The membrane formed a catholyte chamber which was $\frac{1}{2}$ inch in width, 3 inches in depth, and 6 inches in height and an anolyte chamber which was $1\frac{1}{2}$ inch in width, 3 inches in depth, and 6 inches in height.

Two glass storage flasks and circulation pumps wee positioned adjacent to and connected to the anolyte chamber and catholyte chamber so that before and during electrolysis, anolyte and catholyte solutions were continuously circulated through their respective cell chambers and returned to their respective storage flasks. The anolyte storage flask had a volume of 2500 milliliters and the catholyte storage flask had a volume of 500 milliliters.

An anode was positioned vertically in the anode chamber. The anode was a $2\frac{3}{4}$ inch by $5\frac{3}{4}$ inch section of metallic mesh comprised of a titanium substrate coated with a mixed oxide of ruthenium oxide and titanium oxide. The coating was obtained by painting the titanium substrate with butyl titanate and ruthenium trichloride and then oven fired to form the oxides. The finished anode was of the type described in U.S. Pat. No. 3,632,498, issued to H. B. Beer on Jan. 4, 1972. The anode was secured on one side to a 5/16 inch diameter circular titanium rod centrally inserted through one side of the anolyte chamber.

A cathode was positioned vertically in the catholyte chamber. The cathode was a 2¾ inch by 5¾ inch section of type 304 stainless steel wire mesh. The cathode mesh was secured on one side to a 5/16 inch diameter circular stainless steel rod which extended into the catholyte chamber through the opposite side wall of the catholyte chamber.

Both anode and cathode were positioned parallel to the cell membrane. The anode to membrane distance was set at about ½ inch and the cathode to membrane distance was set at about ⅛ inch.

About 1700 milliliters of saturated sodium chloride brine (pH=7.5) and about 300 milliliters of tertiary butyl alcohol were admixed in the 2500 milliliter anolyte storage flask. Anolyte circulation was started from the anolyte storage flask, through the anolyte chamber and back to the anolyte storage flask at a flow rate of about 200 milliliters per minute.

About 500 milliliters of about 17.4% aqueous caustic soda solution was added to the catholyte storage flask. The catholyte circulating pump transferred caustic soda solution from the catholyte storage flask to the catholyte chamber and then back to the catholyte storage flask at a rate of about 50 milliliters per minute.

Electrolysis was carried out at a constant current of about 20.5 amperes. The current density was about 2,000 amperes per square meter. Cell voltage averaged about 5.2 volts throughout the run.

Anolyte pH was maintained at about 7.5 by addition of concentrated caustic (50%) at about 5-minute intervals.

The cell temperature was about 25° C. at the start of the run. At the end of the run, the cell temperature had risen to 35° C. After two hours, (42.0 ampere hours of electrical energy), electrolysis was stopped.

72.3 Grams of tertiary butyl hypochlorite were recovered from the anolyte chamber and the anolyte storage flask. Based on the total weight of recovered tertiary butyl hypochlorite, the anode current efficiency was 85%.

42.8 Grams of NaOH was generated in the catholyte chamber and storage flask. The cathode current efficiency was 68%, based on generated NaOH.

EXAMPLE 2

In this example, conditions were the same as for Example 1, except that the anode to membrane distance was ⅜ inch. 86.2 Grams of tertiary butyl hypochlorite were recovered from the anolyte chamber and storage flask. Based on the recovered tertiary butyl hypochlorite, the anode current efficiency was 64%. 65.4 Grams of NaOH were generated in the catholyte chamber and storage flask. The cathode current efficiency was 65%, based on generated NaOH. Ampere hours used were 67.4. Cell voltage was 4.9 volts.

EXAMPLE 3

In this example, conditions were the same as in Example 2, except that a persulfonic acid membrane surface treated by ethylene diamine having a sulfonamide barrier, sold by du Pont Company under the trademark Nafion® 295, was used as the cell membrane. The anode current efficiency was 66%, based on recovery of 53.8 grams of tertiary butyl hypochlorite product. The cathode current efficiency was 89%, based on the generation of 52.0 grams of NaOH. Ampere hours were 40.3. Cell voltage was 5.7 volts.

EXAMPLE 4

In this example, conditions were the same as Example 2, except that the starting alcohol was 300 milliliters of tertiary amyl alcohol instead of 300 milliliters of tertiary butyl alcohol. 74.4 Grams of tertiary amyl hypochlorite were recovered. The anode current efficiency was about 72%. Based on a NaOH generation of 49.6 grams in the catholyte chamber and catholyte storage flask, the cathode current efficiency was about 74%. Ampere hours were 44.9. Cell voltage was 5.4 volts.

EXAMPLE 5

In this example, conditions were the same as Example 4, except that the starting alcohol was 300 milliliters of 3-methyl-3-pentanol. Based on a recovery of 89.6 grams of 3-methylpentane-3-hypochlorite, the anode current efficiency was 85%. Based on a NaOH generation of 56.2 grams in the catholyte chamber and catholyte storage flask, the cathode current efficiency was 89%. Ampere hours were 42.3. Cell voltage was 5.3 volts.

What is claimed is:

1. A process for the preparation of organic hypohalites in an electrolytic cell having an anolyte chamber containing an anode and a catholyte chamber containing a cathode, separated by a separator, which comprises:

(a) charging a mixture of brine and an organic alcohol into said anolyte chamber wherein said organic alcohol is selected from the group consisting of secondary alcohols, tertiary alcohols, and cyclic alcohols;

(b) charging a dilute aqueous caustic solution to said catholyte chamber;

(c) passing an electric current between said anode and said cathode, whereby organic hypohalite is formed in said anolyte chamber; and (d) recovering said organic hypohalite from said anolyte chamber.

2. The process of claim 1, wherein said organic alcohol is a tertiary alcohol of the form

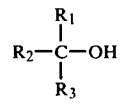

where $R_1$, $R_2$, and $R_3$ are each alkyl or aryl groups having 1 to about 10 carbon atoms each.

3. The process of claim 2, wherein said organic alcohol is tertiary butyl alcohol.

4. The process of claim 2, wherein said organic alcohol is tertiary amyl alcohol.

5. The process of claim 2, wherein said organic alcohol is 3-methyl-3-pentanol.

6. The process of claim 1, wherein said organic alcohol is a secondary alcohol of the form

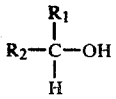

where $R_1$ and $R_2$ are each alkyl or aryl groups having 1 to about 20 carbon atoms each.

7. The process of claim 2, wherein said organic alcohol is cyclohexanol.

8. The process of claim 1, wherein said organic alcohol is a tertiary diol of the form

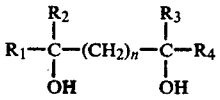

where n is an integer from 1 to about 20 and $R_1$, $R_2$, $R_3$, and $R_4$ are each alkyl or aryl groups having 1 to about 20 carbon atoms each.

9. The process of claim 1, wherein said separator is a permselective cation exchange membrane.

10. The process of claim 9, wherein said brine used in making organic hypohalite is a water soluble alkali metal halide.

11. The process of claim 10, wherein said water soluble alkali metal halide is an alkali metal chloride.

12. The process of claim 11, wherein said alkali metal chloride is an aqueous sodium chloride solution having a concentration in the range from about 175 to about 327 grams of sodium chloride per liter.

13. The process of claim 12, wherein the molar ratio of said brine to said organic alcohol in said anolyte is in the range from about 2:1 to about 20:1.

14. The process of claim 13, wherein the molar ratio of said brine to said organic alcohol in said anolyte is in the range from about 3:1 to about 10:1.

15. The process of claim 14, wherein said cation exchange membrane is prepared by copolymerizing a vinyl ether containing an $—SO_2F$ group having the formula $FSO_2CF_2CF_2OCF(CF_3)CF_2OCF{=}CF_2$ and tetrafluoroethylene, followed by converting the $—SO_2F$ group to a moiety selected from the group consisting of $—SO_3H$, alkali metal sulfonate, and mixtures thereof.

16. The process of claim 15, wherein the basic sulfonyl fluoride polymer is first prepared and the pendant sulfonyl fluoride groups then reacted with a primary amine to form N-monosubstituted sulfonamido groups and salts thereof.

17. The process of claim 15, wherein the basic sulfonyl fluoride polymer is first prepared and the pendant sulfonyl fluoride groups are then reacted with a di- or polyamine with heat treatment to form diamino and polyamine substituents on the sulfonyl fluoride sites of the copolymer.

18. The process of claim 15, wherein said organic solvent is $CCl_4$ and is admixed with said organic alcohol before charging said alcohol to said anolyte chamber and wherein the pH of said anolyte is maintained in the range from about 6.5 to about 8.5.

19. The process of claim 18, wherein said organic alcohol is tertiary butyl alcohol.

20. The process of claim 9, wherein said membrane is a carboxylic acid substituted polymer prepared by reacting a fluorinated olefin with a comonomer having a functional group selected from the group consisting of carboxylic acid and a functional group which can be converted to carboxylic acid.

21. The process of claim 1, wherein the pH of said anolyte is maintained in the range from about 5 to about 9.

22. The process of claim 1, wherein the pH of said anolyte is maintained in the range from about 6.5 to about 8.5.

23. The process of claim 1, wherein the gap distance between said anode and said separator is in the range from about 1/32 inch to about 1 inch.

24. The process of claim 1, wherein the gap distance between said cathode and said separator is in the range from about 1/16 inch to about ½ inch.

25. The process of claim 1, which further comprises admixing a solvent for said organic hypohalite with said organic alcohol before charging said alcohol to said anolyte chamber.

26. The process of claim 1, which further comprises admixing a solvent for said organic hypohalite to said anolyte solution after electrolysis for recovering organic hypohalite from said anolyte chamber.

27. The process of claims 25 or 26, wherein said solvent is an essentially inert organic solvent essentially immiscible with said brine.

28. The process of claim 27, wherein said organic solvent is of the form $$CH_xCl_y$$

where $x+y=4$ and y is an integer from 2 to 4.

29. The process of claim 27, wherein said organic solvent is an organic phosphate of the form

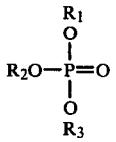

where $R_1$, $R_2$, and $R_3$ are each an alkyl or aryl group each having 1 to about 10 carbon atoms.

30. The process of claim 27, wherein said organic solvent is of the form $$C_2F_xCl_y$$

where y is an integer from 2 to 6 and $x+y=6$.

31. The process of claim 27, wherein said organic solvent is of the form $$C_2H_xCl_y$$

where y is an integer from 1 to 6 and $x+y=6$.

32. The process of claim 27, wherein said organic solvent is of the form $$C_2H_xF_y$$

where y is an integer from 1 to 2 and $x+y=6$.

33. The process of claim 27, wherein said organic solvent is of the form $$C_3H_xCl_y$$

where y is an integer from 1 to about 4 and $x+y=8$.

34. The process of claim 27, wherein said organic solvent is a tertiary halide of the form

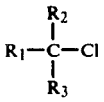

where $R_1$, $R_2$, and $R_3$ are each separate alkyl or aryl groups having from 1 to about 20 carbon atoms each.

35. The process of claim 27, wherein said organic solvent is $CCl_4$.

36. The process of claim 27, wherein said organic solvent is 1,2-dichlorobenzene.

37. The process of claim 27, wherein said organic solvent is 2-chloro-2-methylpropane.

38. The process of claim 29, wherein said organic solvent is selected from a group consisting of 2-chlorotoluene, 3-chlorotoluene, 4-chlorotoluene, and alpha-chlorotoluene.

39. The process of claim 27, wherein said organic solvent is selected from a group consisting of chlorobenzene, 1,2-dichlorobenzene, 1,3-dichlorobenzene, 1,2,4-trichlorobenzene, and fluorobenzene.

* * * * *

UNITED STATES PATENT AND TRADEMARK OFFICE

CERTIFICATE OF CORRECTION

PATENT NO. : 4,182,661

DATED : January 8, 1980

INVENTOR(S) : Richard W. Lynch and Ronald L. Dotson

It is certified that error appears in the above-identified patent and that said Letters Patent are hereby corrected as shown below:

Column 1, line 56, "1°±1°C" should read --2°±1°C--.

Column 1, line 58, after "solution", delete "of" and insert --at--.

Column 6, line 60, "The operating tem-" should be introduced as as a new paragraph.

Column 9, line 16, delete the word "not".

Column 10, line 55, "wee" should read --were--.

Signed and Sealed this

*Twenty-ninth* Day of *April 1980*

[SEAL]

*Attest:*

SIDNEY A. DIAMOND

*Attesting Officer*

*Commissioner of Patents and Trademarks*